US006823707B2

(12) United States Patent
Andras et al.

(10) Patent No.: US 6,823,707 B2
(45) Date of Patent: Nov. 30, 2004

(54) MOBILE FLANGE PRESS AND METHOD

(75) Inventors: Russel Andras, Morgan City, LA (US); Kenneth Caillouet, Thibodaux, LA (US)

(73) Assignee: ABL Fabricators, Inc., Amelia, LA (US)

( * ) Notice: Subject to any disclaimer, the term of this patent is extended or adjusted under 35 U.S.C. 154(b) by 258 days.

(21) Appl. No.: 10/114,942

(22) Filed: Apr. 4, 2002

(65) Prior Publication Data

US 2003/0188565 A1 Oct. 9, 2003

(51) Int. Cl.[7] ..... B21D 9/08; B21B 37/08

(52) U.S. Cl. ..... 72/389.1; 72/389.6; 72/31.02; 72/381; 72/412

(58) Field of Search ..... 72/19.6, 21.1, 72/31.02, 31.03, 381, 389.1, 389.6, 380, 412, 446, 21, 31, 19

(56) References Cited

U.S. PATENT DOCUMENTS

| | | | | |
|---|---|---|---|---|
| 630,484 A | * | 8/1899 | Brown | 72/446 |
| 1,032,218 A | | 7/1912 | Johnson | |
| 1,358,035 A | * | 11/1920 | Reynolds | 72/389.7 |
| 1,796,696 A | | 3/1931 | Trimble | |
| 1,840,237 A | | 1/1932 | Leighton | |
| 2,060,013 A | * | 11/1936 | Baker | 72/389.6 |
| 2,396,496 A | | 3/1946 | Dubie | |
| 2,419,724 A | | 4/1947 | Millard et al. | |
| 2,426,390 A | | 8/1947 | de Forest | |
| 2,726,703 A | | 12/1955 | Fultz | |
| 2,748,829 A | | 6/1956 | Korenak | |
| 2,765,836 A | | 10/1956 | Niekelski | |
| 3,034,583 A | | 5/1962 | Best | |
| 3,270,540 A | | 9/1966 | West | |
| 3,295,350 A | | 1/1967 | Clayborne et al. | |
| 3,335,587 A | | 8/1967 | Blachut et al. | |
| 3,517,538 A | | 6/1970 | Tanenbaum | |
| 3,745,806 A | * | 7/1973 | Ratfield | 72/389.7 |
| 3,765,219 A | * | 10/1973 | Easorn, Jr. | 72/389.7 |
| 3,834,203 A | | 9/1974 | Thompson | |
| 3,949,588 A | | 4/1976 | Seo | |
| 4,077,248 A | | 3/1978 | Lindmark | |
| 4,144,730 A | | 3/1979 | Judge, Jr. | |
| 4,154,073 A | | 5/1979 | Galdabini | |
| 4,203,308 A | | 5/1980 | Davis | |
| 4,488,423 A | | 12/1984 | Newell et al. | |
| 4,493,204 A | | 1/1985 | Merrel | |
| 4,599,878 A | * | 7/1986 | Hudson et al. | 72/21.4 |
| 4,912,957 A | | 4/1990 | Petersen et al. | |
| 4,920,780 A | * | 5/1990 | Switzer | 72/389.6 |
| 4,949,565 A | | 8/1990 | Kodera et al. | |
| 5,161,584 A | | 11/1992 | Krainaker et al. | |
| 5,191,780 A | | 3/1993 | Ohmori et al. | |
| 5,644,939 A | | 7/1997 | Willems | |
| 5,839,315 A | | 11/1998 | Kubik | |

FOREIGN PATENT DOCUMENTS

| | | |
|---|---|---|
| EP | 0 472 765 B1 | 11/1993 |
| EP | 0 634 235 A1 | 1/1995 |
| JP | 63-309301 | 12/1988 |
| JP | 2-42634 | 2/1990 |
| JP | 9-47816 | 2/1997 |
| JP | 9-3227725 | 12/1997 |

* cited by examiner

*Primary Examiner*—David Jones
(74) *Attorney, Agent, or Firm*—Jeffrey L. Costellia; Nixon Peabody LLP

(57) ABSTRACT

A mobile flange press adapted to be mounted on a flange of a workpiece I-beam and moved thereon including at least one clamp that contacts an underside of the flange of the workpiece I-beam, at least one hydraulic cylinder adapted to apply vertical downward pressure on the flange with resulting upward pressure at the ends of the flange to straighten the flange, and a drive mechanism for moving the mobile flange press along the flange of the workpiece I-beam to another portion of the flange. In addition, a method of straightening flanges of a workpiece I-beam where the mobile flange press is moved along the workpiece I-beam while straightening the flange.

38 Claims, 7 Drawing Sheets

MOBILE FLANGE PRESS AND METHOD

BACKGROUND OF THE INVENTION

1. Field of the Invention

The present invention is directed to a flange press for straightening flanges of I-beams. In particular, the present invention is directed to such a flange press which is mobile and movably mounted to I-beam being straightened.

2. Description of Related Art

I-beams are used in various industries for variety of purposes including as structural members or as components in machinery. While some I-beams take their cross sectional shape through extrusion or rolling operations, many others, primarily wider flanged I-beams, take their shape through a fabrication process. In such applications, I-beam components are frequently welded together using conventionally known welding processes.

During the welding of the I-beam components, the flanges of the I-beams often become distorted due to the heat applied at the weld point where the web attaches to the flange. These distortions typically range from 1/16" to 3/8" depending on the thickness and grade of the material used for the I-beams. Of course, typically, I-beams are made of steel so the distortions depend on the thickness and grade of steel used. In addition, workpiece I-beams may also be distorted in that the flange is not perpendicular to the web of the workpiece I-beam. This may occur by improper fitting of the flange to the web or when different amount of heat is applied to the flange from each side of the web welds.

These distortions of the flanges are undesirable and may impede effective use of the I-beams, depending on the application. For instance, these distortions may impede the proper positioning of the other members or components to be welded to the I-beam.

Various devices have been devised to straighten distortions in I-beams that are caused by heat generated in the welding processes. For instance, U.S. Pat. No. 5,191,780 to Ohmori et al. and U.S. Pat. No. 5,644,939 to Willems are noted for disclosing machines for straightening rolled beams such as I-beams. These references disclose stationary machines in which the I-beam are conveyed through the machines while being straightened where straightening rollers remove the distortions.

Similarly, U.S. Pat. No. 2,396,496 to Dubie discloses a work straightening press with a floor supported bed upon which a ram is movably connected and actuated to straightening steel plates or structural assemblies placed on the bed.

SUMMARY OF THE INVENTION

Whereas the prior art teach devices for straightening distortions in I-beams caused by heat generated in the manufacturing processes, these devices have been found to be inadequate for use at a worksite where the welding of I-beams occur. As can be seen, the prior art devices are very large and not readily transportable to the worksite and thus, the distorted I-beams must be brought to the facility having such prior art straightening devices. In addition, the prior art devices require the workpiece I-beams to be lifted and mounted to the device so that the straightening can take place. Thus, significant amount of time, energy, and expense is typically expended to straighten the distortions using the prior art straightening devices.

In view of the foregoing, an advantage of the present invention is in providing a mobile flange press for straightening flanges of I-beams so that the flange press may be used at various worksites where the workpiece I-beams are located.

Another advantage of the present invention is in providing such a mobile flange press which is adapted to be placed on top of the flange of the workpiece I-beam that is to be straightened so that the workpiece I-beam need not be lifted onto the flange press, especially since many I-beams are very long and heavy.

Still another advantage of the present invention is in providing such a mobile flange press which is adapted to be moved on top of the flange as it straightens the flange of the workpiece I-beam so that the workpiece I-beam need not be moved as it is straightened.

Yet another advantage of the present invention is in providing such a mobile flange press that facilitates monitoring of the amount of straightening to the flange.

These and other advantages are attained by a mobile flange press adapted to be mounted on a flange of a workpiece I-beam and moved thereon. The mobile flange press includes at least one clamp that contacts an underside of the flange of the workpiece I-beam, at least one hydraulic cylinder adapted to apply vertical downward pressure on the flange to straighten the flange, and a drive mechanism for moving the mobile flange press along the flange of the workpiece I-beam to another portion of the flange.

In accordance with one embodiment, the drive mechanism includes a drive motor and rollers adapted to roll the mobile flange press along the flange of the workpiece I-beam. In this regard, the drive mechanism preferably includes a lift mechanism for lifting and lowering the mobile flange press relative to the flange of the workpiece I-beam to secure and unsecure the mobile flange press on the workpiece I-beam.

In another embodiment, the a plurality of hydraulic cylinders may be aligned along the length of the mobile flange press. In still another embodiment, the mobile flange press further includes a monitoring mechanism adapted to monitor the amount of straightening to the flange of the workpiece I-beam. In this regard, the monitoring mechanism may include a limit switch for indicating when the flange of the workpiece I-beam has been straightened a predetermined amount.

In yet another embodiment of the present invention, the mobile flange press further includes a controller for controlling operation of the mobile flange press, the controller preferably controlling movement of the mobile flange along the flange of the workpiece I-beam. To allow maximum applicability, the mobile flange press preferably includes an adjustment mechanism in another embodiment for allowing dimensional adjustment of the mobile flange press to accommodate workpiece I-beams of varying dimensions. In addition, the mobile flange press may further include guides for limiting lateral movement of the mobile flange press relative to the workpiece I-beam. Furthermore, the mobile flange press may further include at least one lateral press adapted to exert a lateral force on a web of the workpiece I-beam, and a plum indicator for indicating inclination of the mobile flange press.

Another aspect of the present invention is in providing an improved method of straightening flanges of a workpiece I-beam including the steps of placing a mobile flange press on top of a first portion of the flange of the workpiece I-beam, securing the mobile flange press to the first portion of the flange of the workpiece I-beam, applying pressure to the first portion of the flange to straighten the first portion of the flange, unsecuring the mobile flange press from the first portion of the flange, moving the mobile flange press along the top of the flange to a second portion of the flange, securing the mobile flange press to the second portion of the flange of the workpiece I-beam, and applying at least pressure to the second portion of the flange to straighten the second portion of the flange.

In accordance with embodiments of the present invention, the step of securing the mobile flange press may be attained by at least one clamp that contacts an underside of the flange. In another embodiment, the step of applying pressure may be attained by at least one hydraulic cylinder that applies vertical downward pressure on the flange. In accordance with another embodiment of the present invention, the method further includes the step of monitoring amount of straightening to the flange. The step of moving the mobile flange press along the top of the flange is preferably attained in yet another embodiment by a drive mechanism secured to the mobile flange press. In addition, the method may further include the steps of monitoring inclination of the mobile flange press and rotating the mobile flange press based on inclination of the flange press.

These and other advantages and features of the present invention will become more apparent from the following detailed description of the preferred embodiments of the present invention when viewed in conjunction with the accompanying drawings.

DETAILED DESCRIPTION OF THE PREFERRED EMBODIMENT

A mobile flange press in accordance with various embodiments of the present invention is described below which provides numerous advantages noted above. As will be appreciated, the mobile flange press in accordance with the present invention allows straightening and/or removal of the previously described distortions in the flange of a workpiece I-beam at various worksites where the workpiece I-beams are located thereby allowing economic straightening of flanges.

Figure 1:
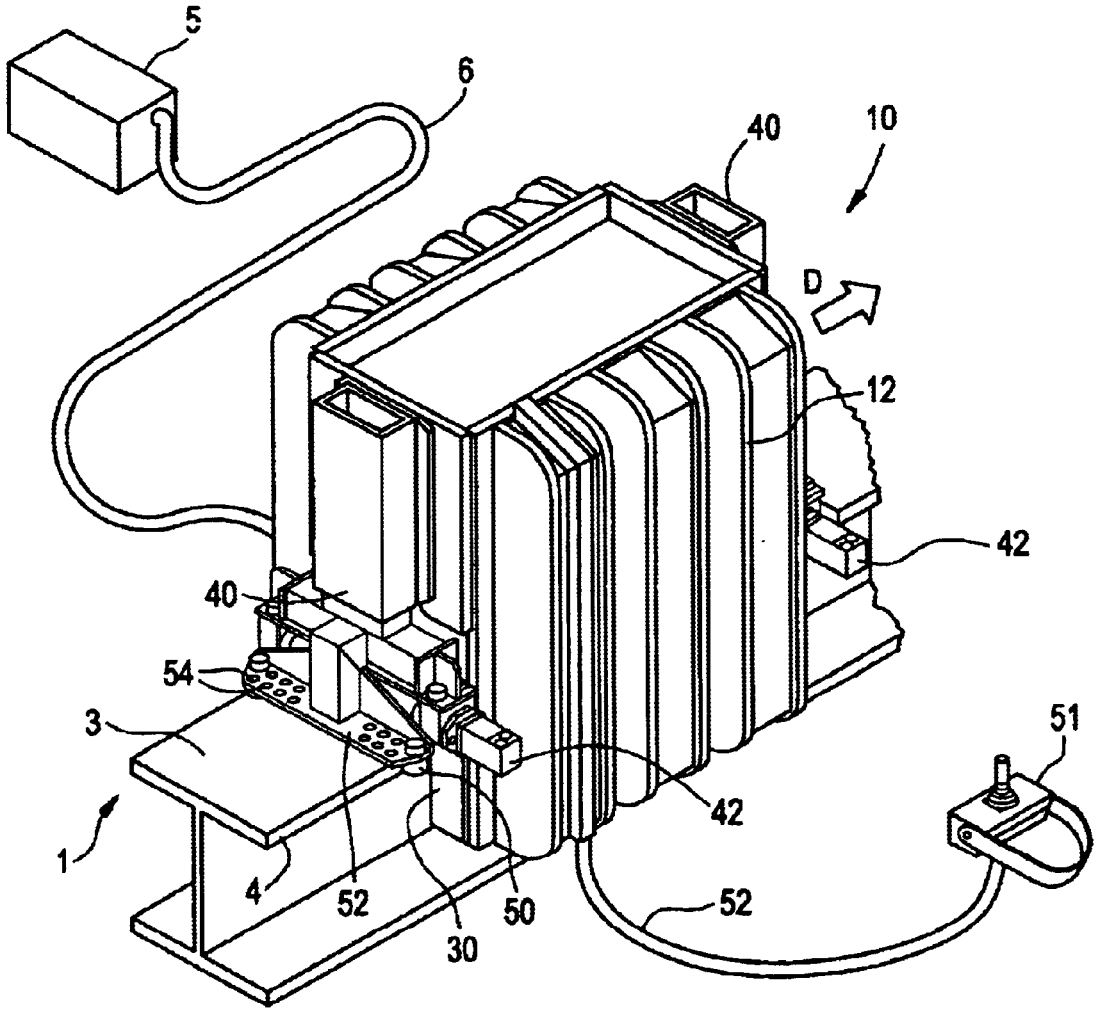
FIG. 1 is a perspective view of a mobile flange press in accordance with one embodiment of the present invention being used to straighten a flange of a workpiece I-beam.

FIG. 1 is a perspective view of a mobile flange press 10 in accordance with one embodiment of the present invention which is shown being used to straighten and/or remove the previously described distortions in the flange 3 of a workpiece I-beam 1. Such a workpiece I-beam 1 in which the flange 3 is distorted is more clearly illustrated in FIG. 3 discussed in further detail below. Of course, the workpiece I-beam 1 is not part of the mobile flange press 10 itself but is merely shown in the various figures discussed below to illustrate the mounting and operation of the mobile flange press 10. In this regard, FIG. 1 and FIG. 2 should be viewed together for clarity, FIG. 2 showing a side view of the mobile flange press of FIG. 1 but with the various internal components being shown by dashed lines.

Figure 2:
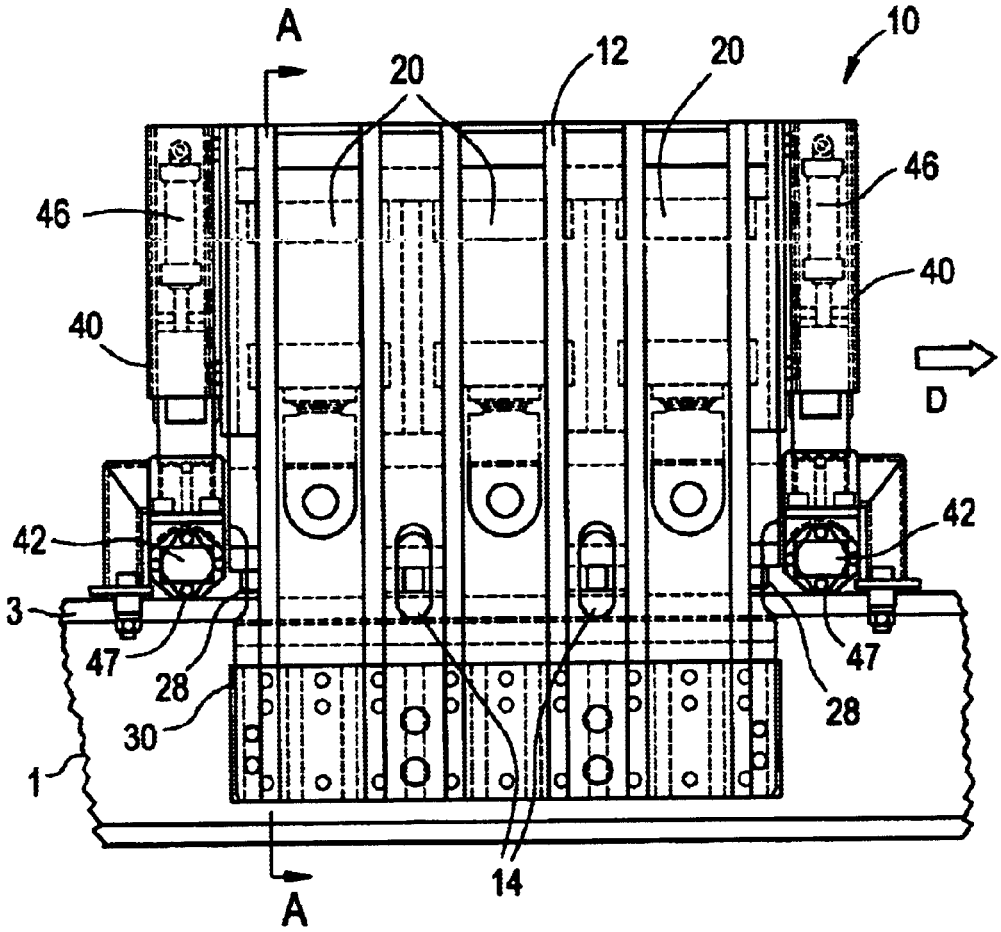
FIG. 2 is a side view of the mobile flange press of FIG. 1 but with the internal components being shown by dashed lines.

As can be seen in FIGS. 1 and 2, a significant advantage of the mobile flange press 10 is that it is portable and adapted to be placed on top of the flange 3 of the workpiece I-beam 1 that is to be straightened in the manner shown. Thus, the workpiece I-beam 1 itself need not be lifted as required with flange presses known in the art, but the workpiece I-beam 1 can be left supported by the ground or other surface such as on a floor of a building. The workpiece I-beam 1 may even be already laterally mounted at its ends to other support structures to serve as a structural cross member. As will be discussed in further detail below, another advantage of the mobile flange press 10 is that it is adapted to be moved on top of the flange 3 as it straightens the flange 3 so that the workpiece I-beam 1 need not be moved at all as it is straightened.

The illustrated embodiment of the mobile flange press 10 includes a press frame 12 for mounting to flange 3 and at least one hydraulic cylinder such as three hydraulic cylinders 20 shown schematically in FIG. 2 which are adapted to apply vertical downward pressure on the flange 3 to straighten the flange 3. It should be noted that frame 12 should be understood to comprise various structural elements to which the various components of the mobile flange press 10 is ultimately supported. In this regard, the frame 12 is preferably made of a strong, rigid material such as steel of sufficient grade and thickness to allow exertion of sufficient force through the hydraulic cylinders 20 to straighten the workpiece I-beam 1 without permanently deforming or otherwise damaging the frame 12. The three hydraulic cylinders 20 of the present example are 12 inch bore press cylinders with approximately 4000 PSI capacity that are mounted along approximately a five foot length of the mobile flange press 10 to allow straightening of approximately five foot portions or segments of the flange 3 of the workpiece I-beam 1. However, it should be noted that in other embodiments of the present invention, different number of hydraulic cylinders or different sized hydraulic cylinders with different pressure capacity arranged in different configurations may be provided to straighten different thickness and sized portions of the flange 3, depending on the desired configuration and capacity of the mobile flange press.

The mobile flange press 10 further includes clamps 30 discussed in further detail below that contact an underside of the flange 3 of the workpiece I-beam 1 to provide balancing force against the hydraulic cylinders 20 to thereby allow the straightening of the flange 3. Also mounted to the frame 12 is a pair of drive mechanisms 40 for moving the mobile flange press 10 along the flange 3 of the workpiece I-beam 1 to another portion of the flange 3 as also described below.

FIG. 1 also shows a controller 51 for controlling operation of the mobile flange press 10 such as the movement of the mobile flange press 10 along the flange 3 of the workpiece I-beam 1, the operation of the hydraulic cylinders 20, and other operations of the mobile flange press 10. In this regard, the controller 51 may be connected to control the mobile flange press 10 by an electrical connection 52. Of course, in other embodiments, a wireless communication may be used instead such as by radio or infrared control. In addition, whereas the present embodiment of the controller 51 is provided with a joy stick, other types of input mechanisms may be used including electronic keypads, portable computerized devices, buttons, toggle switches, dial inputs, etc.

A hydraulic supply 5 is also connected to the mobile flange press 10 via supply line 6 to provide pressurized hydraulic fluid to the hydraulic cylinders 20 and the drive mechanisms 40. The hydraulic supply 5 preferably has enough pressure and fluid capacity to provide sufficient fluid to the hydraulic cylinders 20 of the mobile flange press 10. In this regard, the hydraulic supply 5 may incorporate a hydraulic pump and hydraulic fluid supply (not shown) as known in the art. In the present embodiment, a fifty horsepower hydraulic power unit may be used. Of course, in other embodiments, an appropriate hydraulic power unit with different capacity may be used depending on the capacity of the mobile flange press 10. In addition, the hydraulic supply 5 may be provided directly on the mobile flange press itself in other embodiments. However, this may reduce the mobility of the mobile flange press 10 thereby reducing its utility.

Figure 3:
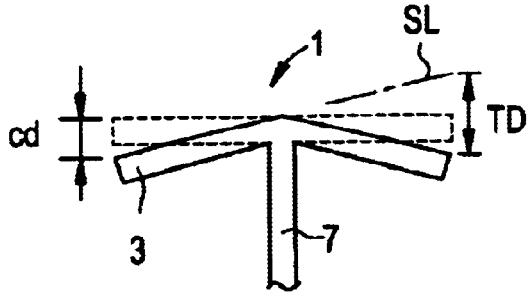
FIG. 3 is an end view of the workpiece I-beam, the distortion of the flange due to welding process being shown exaggerated.

FIG. 3 is an end view of the workpiece I-beam 1 where the flange 3 has been distorted due to the welding of the web 7 on to the flange 3 for which the mobile flange press 10 in accordance with the present invention may be used to remove such distortion. In the figure, the distortion of the flange 3 is shown greatly exaggerated and the desired position of the flange 3, which when straightened, is shown by the dashed representation of the flange 3. Generally, the flange 3 tends to distort in the manner shown where the flange 3 is distorted inwardly toward the web 7, each side of the flange 3 distorting approximately the same amount. The amount or distance of the flange 3 to be straightened may be determined by placing a straight edge along one side of the flange 3 to thereby define the straight line "SL", and measuring the total distance "TD" between the straight line SL and the other side of the flange 3 in the manner shown. Then, the total distance TD is divided in half to obtain the correction distance "cd" of the flange 3 to be straightened. This correction distance cd, while only an approximation, provides sufficient accuracy of the amount the flange 3 should be straightened using the mobile flange press 10. Of course, other techniques and devices may be used to determine the correction distance cd as well and the method discussed above is provided merely as one example method.

To facilitate monitoring of the amount of the flange 3 straightened by the mobile flange press 10 in any given portion of the flange 3 of the workpiece I-beam 1, the frame 12 of the mobile flange press 10 may be provided with access openings 14 as shown in FIG. 2. A straight edge or other measurement equipment such as a dial indicator may be inserted to contact the flange 3 of the workpiece I-beam 1 to measure the amount the flange 3 has been straightened by the mobile flange press 10. In this regard, as can be also seen in FIG. 2, the punch 28 described in detail below is discontinuous at these access openings 14 to provide easier access to the flange 3 of the workpiece I-beam 1.

Figure 4:
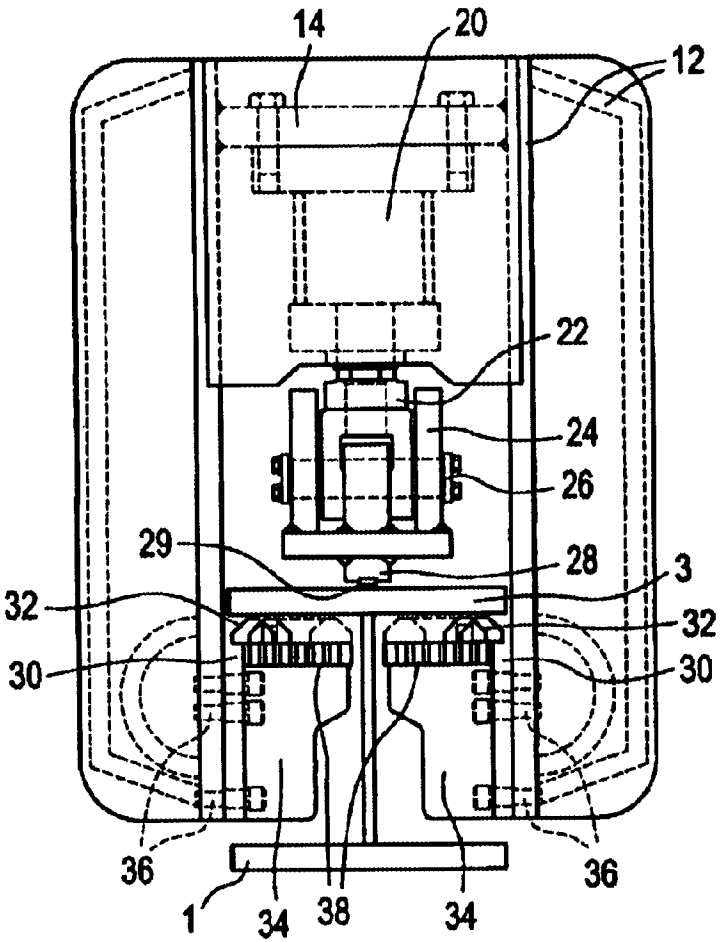
FIG. 4 is a cross-sectional view of the mobile flange press of FIG. 2 as viewed along A—A clearly showing one embodiment of a hydraulic cylinder.

Referring to FIG. 2 and FIG. 4 which is a cross-sectional view of the mobile flange press 10 of FIG. 2 as viewed along A—A, the details of the hydraulic cylinders 20 can be appreciated. In particular, as most clearly shown in FIG. 4, the hydraulic cylinder 20 is securely mounted to a structural member 14 of the frame 12. In this regard, the structural members of the frame 12 should be made robust enough to ensure that the frame 12 can withstand the forces exerted by the hydraulic cylinders 20 during operation of the mobile flange press 10. A plunger 24 is secured to the clevis 22 of the hydraulic cylinder 20 using a pin 26. The plunger 24 includes one punch 28 or more which contacts the flange 3 of the workpiece I-beam 1 to exert a force thereon. In the present illustrated embodiment, the plunger 24 is an elongated piece which is attached to all three of the hydraulic cylinders 20 with three punches 28 extending a partial length of the plunger 24 below the clevis 22 of each hydraulic cylinder 20. In this regard, whereas in the embodiment shown, the punches 28 are welded to the plunger 24, the punches 28 are preferably removably attached to the plunger 24. Moreover, a single punch extending the length of the plunger 24 may also be provided in other embodiments as well.

FIG. 4 shows the mobile flange press 10 with the hydraulic cylinders 20 retracted so that the punch 28 is not contacting the flange 3 of the workpiece I-beam 1. However, it should be evident that upon actuation of the hydraulic cylinders 20, the clevis 22 with the plunger 24 would extend so that the punch 28 contacts the flange 3 to exert a force thereon. In the illustrated embodiment of FIG. 4, the punch 28 includes two contact points which contact the top of the flange. The two contact points 29 are provided so that if the flange does not bend exactly the same amount on each side, the mobile flange press 10 will avoid merely sliding to the longer side. Thus, the two contact points 29 help to ensure that the ends of the flange will be straightened to the same degree even though the original ends were not deformed evenly.

It should also be appreciated that in the illustrated embodiment, the plunger 24 is removable by removing the pin 26 so that a plunger having a different configuration may be attached to the clevis 22 of the hydraulic cylinders 20. For instance, in other embodiments, the plunger need not be attached to all three of the hydraulic cylinders 20 but instead, each hydraulic cylinder may have an individual plunger. It should also be evident that in other embodiments, the punch 28 may be removably attached to the plunger 24. In addition, whereas the plunger 24 is attached to the hydraulic cylinders 20 by the pin 26 in the illustrated example, the plunger 24 may be attached in any appropriate manner such as by using fasteners or being threaded onto the clevis 22 itself, etc.

Referring again to FIG. 4, mobile flange press 10 further includes clamps 30 secured to the frame 12. The clamps have contact bits 32 that extend the length of the clamp and contact an underside of the flange 3 of the workpiece I-beam 1 to provide balancing force against the force exerted on the flange 3 by the hydraulic cylinders 20 when the flange 3 is straightened. As can be seen, the clamps 30 of the present embodiment includes support flanges 34 that aid in distribution of the pressure exerted on the contact bits 32. In the illustrated embodiment, the clamps 30 are secured to the frame 12 using fasteners 36 but in other embodiments, clamps 30 may be secured by other means.

In addition, the mobile flange press 10 is provided with an adjustment mechanism for allowing dimensional adjustment to accommodate workpiece I-beams of varying dimensions, for instance, workpiece I-beams having different width and thickness dimensions. In this regard, in the present illustrated embodiment, the contact bits 32 are secured to the clamps 30 by fasteners and the clamps 30 are provided with plurality of mounting points 38 to allow the contact bits 32 to be changed or moved as can be seen by the broken line representations of the contact bits. Thus, the contact bits 32 may be positioned closer together toward the web of the I-beam if the flange of the workpiece I-beam is small. In addition, the contact bits 32 may be removed and replaced with contact bits that are taller or shorter in height to accommodate thinner or thicker flanges, respectively. Correspondingly, maximum applicability of the mobile flange press is attained by providing the adjustment mechanism. Of course, in other embodiments, the adjustment mechanism may be made differently and may include various attachments of different shapes, slides, worm gear, or rack/pinion type devices, as well as separate hydraulic mechanisms and other mechanical devices. These adjustment mechanisms should be considered to be within the scope of the present invention as long as the adjustment mechanism allows the mobile flange press to accommodate workpiece I-beams of varying dimensions.

Figure 5:
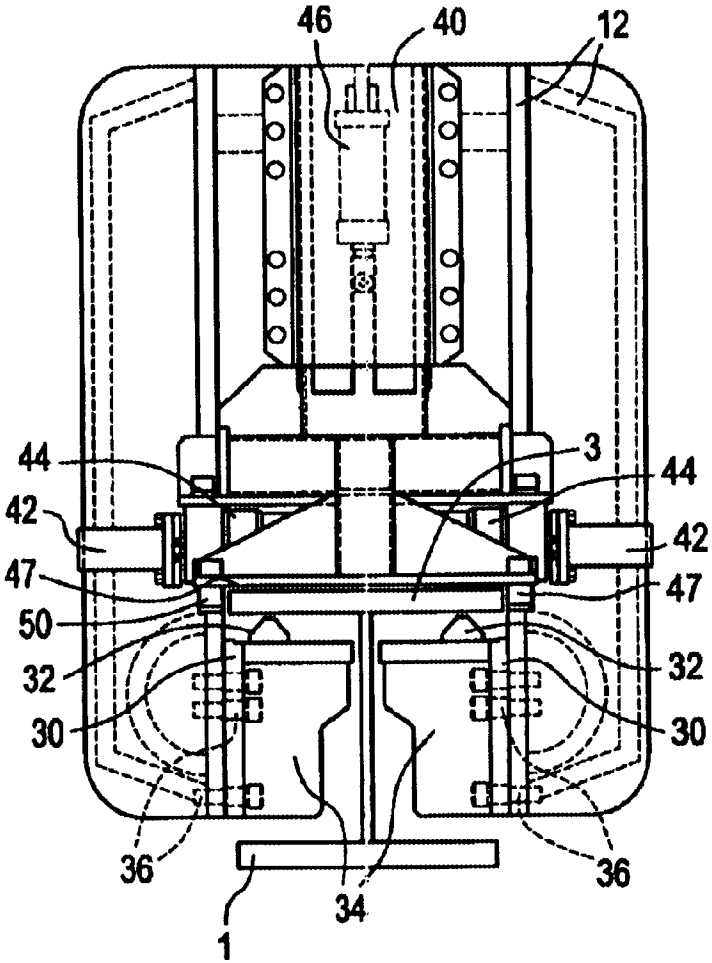
FIG. 5 is a frontal view of the mobile flange press of FIG. 2 clearly showing one embodiment of a drive mechanism.
Figure 6:
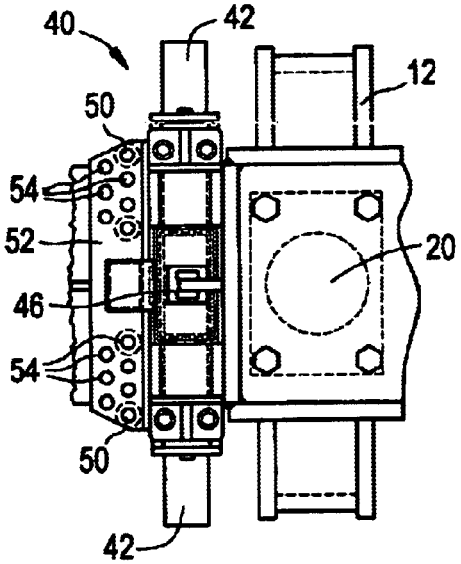
FIG. 6 is a top view of the drive mechanism of FIG. 5.

FIG. 5 shows the front view while FIG. 6 shows the top view of one of the drive mechanisms 40 used to move the mobile flange press 10 along the flange 3 of the workpiece I-beam 1 to another portion of the flange 3, for instance, in the direction of arrow "D" as shown in FIGS. 1 and 2. In the illustrated embodiment, two drive mechanisms 40 are provided, one at each end of the frame 12 of the mobile flange press 10 as more clearly shown in FIG. 2, that are operated, preferably, in a synchronized manner, to move the mobile flange press 10 along the length of the workpiece I-beam 1 as the flange 3 is straightened by the hydraulic cylinders 20 described above.

Each of the drive mechanisms 40 includes two drive motors 42 and rollers 44 adapted to roll the mobile flange press 10 along the flange 3 of the workpiece I-beam 1, as well as lift mechanisms 46 that allow lowering and lifting of the mobile flange press 10 relative to the workpiece I-beam 1. It should be noted that each of the rollers 44 of each drive mechanism 40 shown in the present embodiment at the ends of the mobile flange press 10 are generally elongated in shape. This allows the rollers 44 to accommodate flanges of differing widths.

As can be appreciated from examining FIGS. 2 and 5, when the lift 46 of the drive mechanism 40 is operated to either a lowered position or a raised position, the mobile flange mechanism 10 is moved vertically relative to the workpiece I-beam 1. In this regard, the lift 46 of the drive mechanism 40 exerts lifting force against the rollers 44 which contact the top surface of the flange 3 along the contact areas 47 as most clearly shown in FIGS. 2 and 5. These figures show the lift mechanisms 46 of the drive mechanisms 40 in their lowered position where the frame 12 is lowered relative to the workpiece I-beam 1 so that the contact bits 32 of the clamps 30 are at a spaced distance away from the underside of the flange 3 as shown in FIG. 5. In this position, the drive motors 42 may be operated to move the mobile flange press 10 along the flange 3 of the workpiece I-beam 1 from one portion of the flange 3 to another portion. Of course, the hydraulic cylinders 20 should also be fully retracted as well so that the plunger 24 or the punch 28 secured thereon does not contact the flange 3.

In contrast, when the lift mechanisms 46 of the drive mechanisms 40 are raised relative to the workpiece I-beam 1 into their raised position by exerting a lifting force on the rollers 44, the contact bits 32 of the clamps 30 contact the underside of the flange 3 or are in close proximity to the underside of the flange 3. When in this position, the hydraulic cylinders 20 is then actuated so that the punch 28 contacts and presses downwardly on the flange 3. If the contact bits 32 did not contact the underside of the flange 3, the mobile flange press 10 will be lifted slightly by the downward force of the hydraulic cylinders 20 thereby causing the contact bits 32 of the clamps 30, contact the underside of the flange 3. In this manner, the mobile flange press 10 is secured to the workpiece I-beam 10 so that it can be used to straighten the flange 3. Then, through the continued exertion of the downward force by the hydraulic cylinders 20 and the corresponding balancing force exerted by the clamps 30, the portion of the flange to which the mobile flange press 10 is attached is straightened in accordance with the present invention. When the flange is straight as desired, the hydraulic cylinders 20 are then retracted.

In the illustrated embodiment, the lift mechanism 46 is a 3.25 inch bore hydraulic lift which utilizes pressurized hydraulic fluid from the hydraulic supply 5 and is of sufficient capacity to lift the mobile flange press 10 on the workpiece I-beam 1. However, in other embodiments, the lift mechanism 46 may be provided using other devices such as electric motors which are designed to provide the required lift capacity. In addition, in the present embodiment, the drive motors 42 are hydraulic motors which operate using the pressurized hydraulic fluid from the hydraulic supply 5. However, in another embodiment, the drive motors may be DC servo motors which are advantageous in that they can be precisely controlled to allow precise positioning of the mobile flange press 10 on the flange 3 of the workpiece I-beam 1. Of course, in other embodiments, the drive motors may be any type of motor such as a pneumatic, or another type of electric motor. Furthermore, in yet other embodiments, a different number or types of drive motors and rollers may be used, as long as they are capable of moving the mobile flange press from one portion of the flange to another portion of the flange along the length of the workpiece I-beam. For instance, a single drive motor of sufficient power may be provided at one end of the frame while the other end is merely provided with an idler roller. In addition, the rollers may be individual rollers instead of the elongated shaped rollers shown.

In addition, in the above described manner, after the flange has been straightened, the lift mechanism 46 is then lowered so that the contact bits 32 of the clamps 30 are at a spaced distance away from the underside of the flange 3 as again shown in FIG. 5 thereby unsecuring the mobile flange press 10 from the workpiece I-beam 1. In this position, the drive motors 42 of the lift mechanism 46 are again operated to move the mobile flange press 10 along the flange 3 of the workpiece I-beam 1 to another portion of the flange 3. The above noted process can be repeated to straighten another portion of the flange 3. In particular, the lift mechanism 46 is operated to secure and unsecure the mobile flange press 10 from the flange 3 of the workpiece I-beam 1 and then the mobile flange press 10 is moved via the drive motors 42 and rollers 44 to move the mobile flange press 10 to another portion of the flange 3.

To ensure proper centered alignment of the mobile flange press 10 relative to the workpiece I-beam 1 as the mobile flange press 10 is moved along the flange 3 of the workpiece I-beam 1, guides 50 are provided in the present embodiment for limiting lateral movement of the mobile flange press 10. The guides 50 are preferably rollers that contact the edge surface 4 of the flange 3 as shown in FIG. 1. As can also be seen in FIGS. 1, 5 and 6, the guides 50 are preferably mounted to an adjustable flange 52 with a plurality of mount holes 54. These mount holes 54 may be used so that the position of the guides 50 may be changed depending on the width of the flange of the workpiece I-beam thereby facilitating the use of the mobile flange press 10 to straighten I-beams of different dimensions in the manner described previously. Of course, in other embodiments of the present invention, the guides 50 may be made differently and may be provided with mechanisms such as slides, worm gears, rack/pinion type devices, and other mechanical devices that facilitate the proper positioning of the guides 50 to properly maintain lateral alignment of the mobile flange press 10 relative to the workpiece I-beams. For instance, the guides 50 may be mounted on a hydraulic powered screw with threads on each end. In such an example, adjustment of the position of the guides 50 may be made from push buttons or other input mechanism on the controller 51 shown in FIG. 1 so that the mobile flange press 10 may be easily centered on the flange of the workpiece I-beam.

Figure 7A:
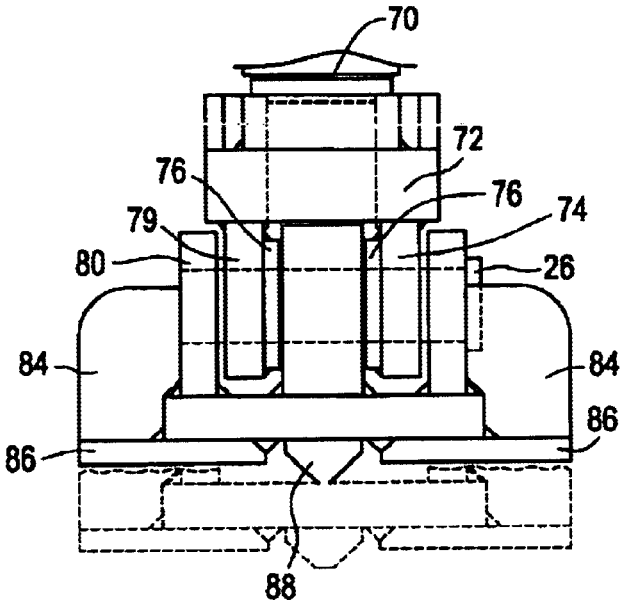
FIG. 7A is an enlarged cross-sectional view of another embodiment of the plunger secured to the hydraulic cylinder.
Figure 7B:
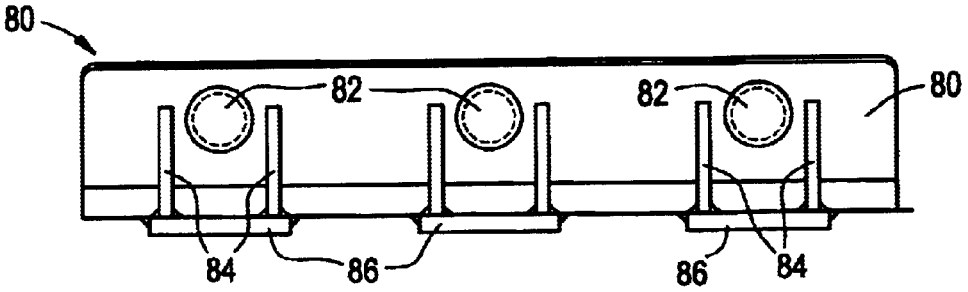
FIG. 7B is a side profile view of the plunger shown in FIG. 8A with the punch removed.

FIG. 7A is an enlarged cross-sectional view of another embodiment of a plunger 80 secured to the hydraulic cylinder 70, FIG. 7B showing a side profile view of the plunger 80 with the punch 88 removed. Like the embodiment described previously, the plunger 80 is mounted to the flanges 74 of the clevis 72 via pin 26 which is received through the pin holes 82 of the plunger 80 in the manner shown. As can be seen, the illustrated embodiment of the hydraulic cylinder 70 differs in that it is provided with reinforcement plates 76 which is secured to the flanges 74 of the hydraulic cylinder 70 to reinforce the clevis 72 and to increase the bearing surface for the pin 26. The plunger 80 is displaced upon actuation of the hydraulic cylinder 70 to the extended position as represented by the dashed representation. The plunger 80 attaches to all three of the hydraulic cylinders of the mobile flange press so that the hydraulic cylinders are actuated together.

In addition, the plunger 80 further includes base plates 86 which are secured to the plunger 80 and reinforced thereon by gusset plates 84. As can be appreciated from FIG. 7A, the base plates 86 serve as a cylinder stop assembly to prevent full extension of the hydraulic cylinder 70. Because the base plates 86 extend laterally in the manner shown, they contact the flange of the workpiece I-beam thereby preventing further extension of the hydraulic cylinder 70. Moreover, in the event that the mobile flange press is operated without being mounted to the flange of the workpiece I-beam, the base plates 86 eventually contact the contact bits of the clamps (not shown) so that full extension of the hydraulic cylinder 70 is prevented. Depending on the specification of the hydraulic cylinders, the prevention of such full extension of the hydraulic cylinders may be important since upon full extension, the hydraulic pressure exerted by the hydraulic cylinders are borne by the tie rods (not shown) which hold the components of the hydraulic cylinders together. Since the hydraulic cylinders may exert pressures of up to approximately 4000 PSI in the present illustrated embodiment, such force may exceed the load capacity of the tie rods thus causing damage to the hydraulic cylinder 70. Thus, the base plates 86 prevent such full extension of the hydraulic cylinder 70 thereby minimizing risk of damage to the hydraulic cylinder 70.

Figure 8B:
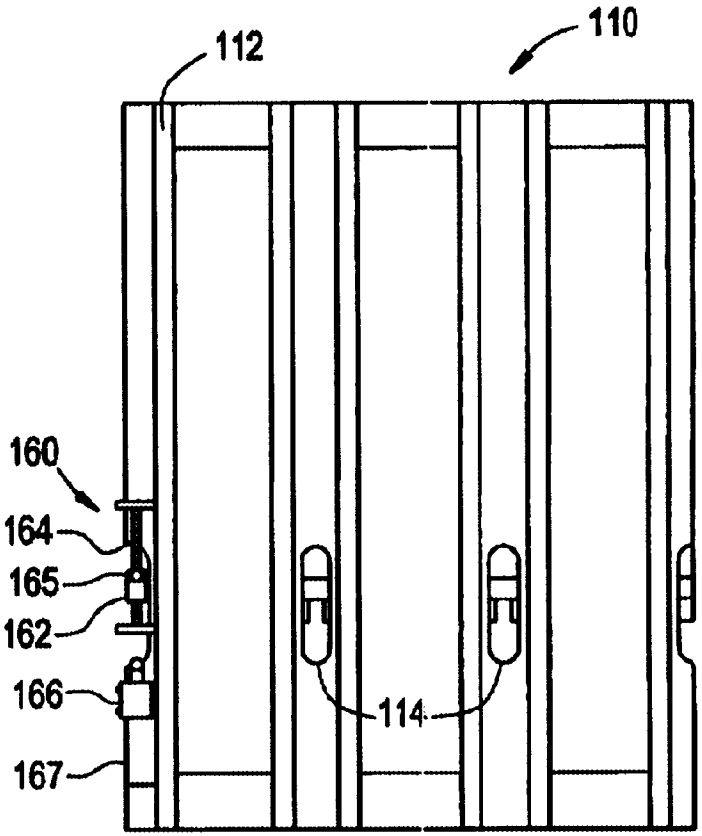
FIG. 8B is a side view of the mobile flange press of FIG. 9A.
Figure 8A:
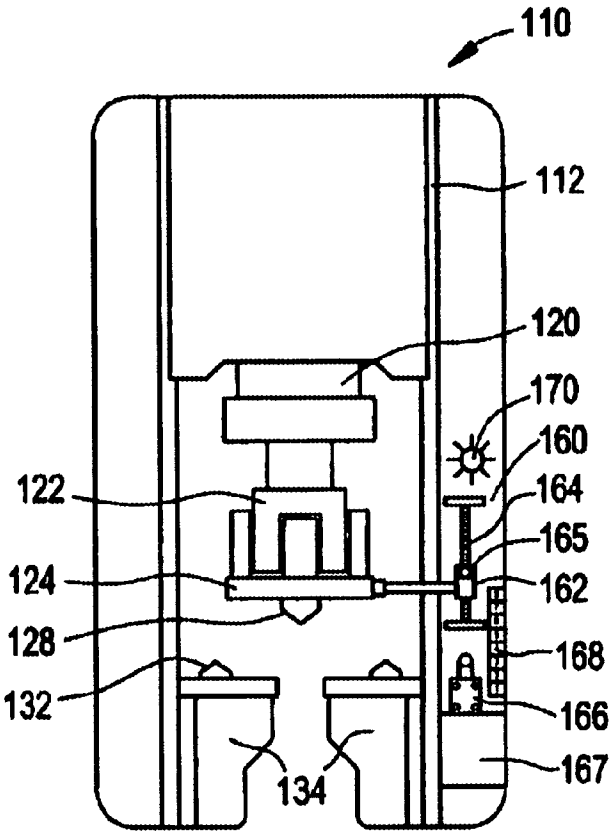
FIG. 8A is an end view of a mobile flange press in accordance with another embodiment of the present invention including a monitoring mechanism.

FIGS. 8A and 8B show a mobile flange press 110 in accordance with another embodiment of the present invention including a monitoring mechanism 160 described in further detail below which allows close monitoring of the amount the flange of the workpiece I-beam (not shown) is straightened. The drive mechanism has been omitted in this illustration to more clearly show the monitoring mechanism 160 and its operation. As can be seen in these figures, the monitoring mechanism 160 includes a fixture 162 secured to the plunger 124 that receives a threaded adjustment rod 164 that is lockable via lock nut 165, and limit switch 166 secured to the frame 112 of the mobile flange press 110 for indicating when the flange of the workpiece I-beam has been straightened a predetermined amount.

In this regard, a scale 168 is provided on the frame 112 showing the displacement of the fixture 162 and correspondingly, the plunger 164, as well as an indicator light 170 electrically connected to the limit switch 166 which is illuminated when the limit switch 166 is triggered by the adjustment rod 164. In addition, the limit switch 166, when triggered, actuates a valve 167 which may be a directional hydraulic valve, that dumps the pressurized hydraulic fluid in the hydraulic cylinders 120 to immediately terminate the pressure exerted on the workpiece I-beam and stop the bending process.

The fact that the limit switch 166 and the contact bits 132 are attached to the frame 112 of the mobile flange press 110 while the adjustment rod 164 and the punch 128 are attached to the plunger 124 means that the relative movement of the punch 128 with respect to the contact bits 132 is being measured by the monitoring mechanism 160. This measurement is also the true displacement of the flange of the workpiece I-beam since the monitoring mechanism 160 is also measuring how far down the plunger 124 moves and simultaneously, how far up the contact bits 132 move. Moreover, this measurement is made irrespective of any deflection in the frame 112 of the mobile flange press 110.

The monitoring mechanism 160 of the mobile flange press 110 may be utilized in the following described manner to monitor the amount the flange of the workpiece I-beam is straightened. In the same manner as the previously described in the embodiment of FIG. 1, the mobile flange press 110 is secured to the portion of the flange to be straightened by extending a lift mechanism of the drive mechanism (not shown) so that the frame 112 of the mobile flange press 110 is lifted to the point where the contact bits 132 secured on the clamps 134 contact the underside of the flange. The hydraulic cylinders 120 are extended until the punch 128 contacts the top surface of the flange of the workpiece I-beam until the pressure gauge corresponding to the pressure of the hydraulic cylinder 120 displays approximately 400 PSI and then, the extension of the hydraulic cylinders 120 is terminated. This pressure is then released while maintaining the contact position of the punch 128.

At this point which is the starting or zero point, the position of the adjustment rod 164 is adjusted until it contacts the limit switch 166 which actuates the valve 167 to terminate the exertion of hydraulic force and causes the indicator light 170 to illuminate. The adjustment rod 164 is then adjusted (upwardly in the present embodiment) off the limit switch 166 an amount corresponding to the desired correction distance cd determined in the manner discussed above relative to FIG. 3 (or in another manner) using the scale 168 to reference how much the adjustment rod 164 is adjusted. The position of the adjustment rod 164 is secured using the lock nut 165. As can be appreciated, this effectively sets the monitoring mechanism 160 to illuminate the indicator light 170 when the flange of the workpiece I-beam is bent the desired correction distance cd.

In further detail, the operator of the mobile flange press 110 sets the contact bits 132 and punch 128 so that they touch the bottom and top of the flange of the workpiece I-beam, respectively, but are not applying any hydraulic pressure to the workpiece I-beam. This is the start or zero point. The operator then screws down on the adjustment rod 164 until the point when the indicator light 170 illuminates indicating that the operator has reached the point where the limit switch 166 is actuated. The operator then screws up the adjustment rod 164 by the amount desired to move the punch 128 relative to the clamp bits 132 which also corresponds to the amount the flange of the workpiece I-beam will be straightened.

Upon securing of the adjustment rod 164, the operator operates the mobile flange press 110 so that the hydraulic cylinders 120 are extended to the pressure required to actually bend the flange of the workpiece I-beam the desired correction distance cd, for instance, up to 4000 PSI in the presently described example. When the limit switch 166 is actuated, the indicator light 170 is illuminated and the valve 167 is actuated to terminate the exertion of hydraulic force by the hydraulic cylinders 120, and thus, terminating the bending process without further input by the operator in the presently described embodiment. Then, the hydraulic cylinders 120 may be retracted. To ensure the accuracy of the positioning of the adjustment rod 164, the flange may be accessed through the access openings 114 using a straight edge or other measurement equipment such as a dial indicator to measure the amount the flange has been straightened by the mobile flange press 110. Based on the findings, the adjustment rod 164 can then be readjusted accordingly.

The mobile flange press 110 can then be unsecured by lowering the lift mechanism of the drive mechanism (not shown) so that the clamp bits 132 no longer contact the underside of the flange of the workpiece I-beam and the mobile flange press 110 can be readily moved to another portion of the flange along the I-beam for straightening, for instance, in approximately five foot increments. Then, the mobile flange press 110 can be secured to the new portion of the workpiece I-beam in the manner already described and the hydraulic cylinders 120 operated to straighten this portion of the workpiece I-beam. This process can be repeated for the length of the workpiece I-beam to thereby straighten the entire flange without moving the workpiece I-beam.

Of course, the monitoring mechanism 160 shown and discussed above is merely one example that may be provided on the mobile flange press. In other embodiments, the monitoring mechanism may include different types of devices which monitor amount of flange straightening in a different manner. Moreover, it should also be noted that the mobile flange press in accordance with the present invention may also be provided with additional features such as a heater adapted to heat the portion of the flange to be straightened. Such heating may be attained by any known method including by a torch type heater, by an electrical heater, or by high current induction heating.

Figure 9:
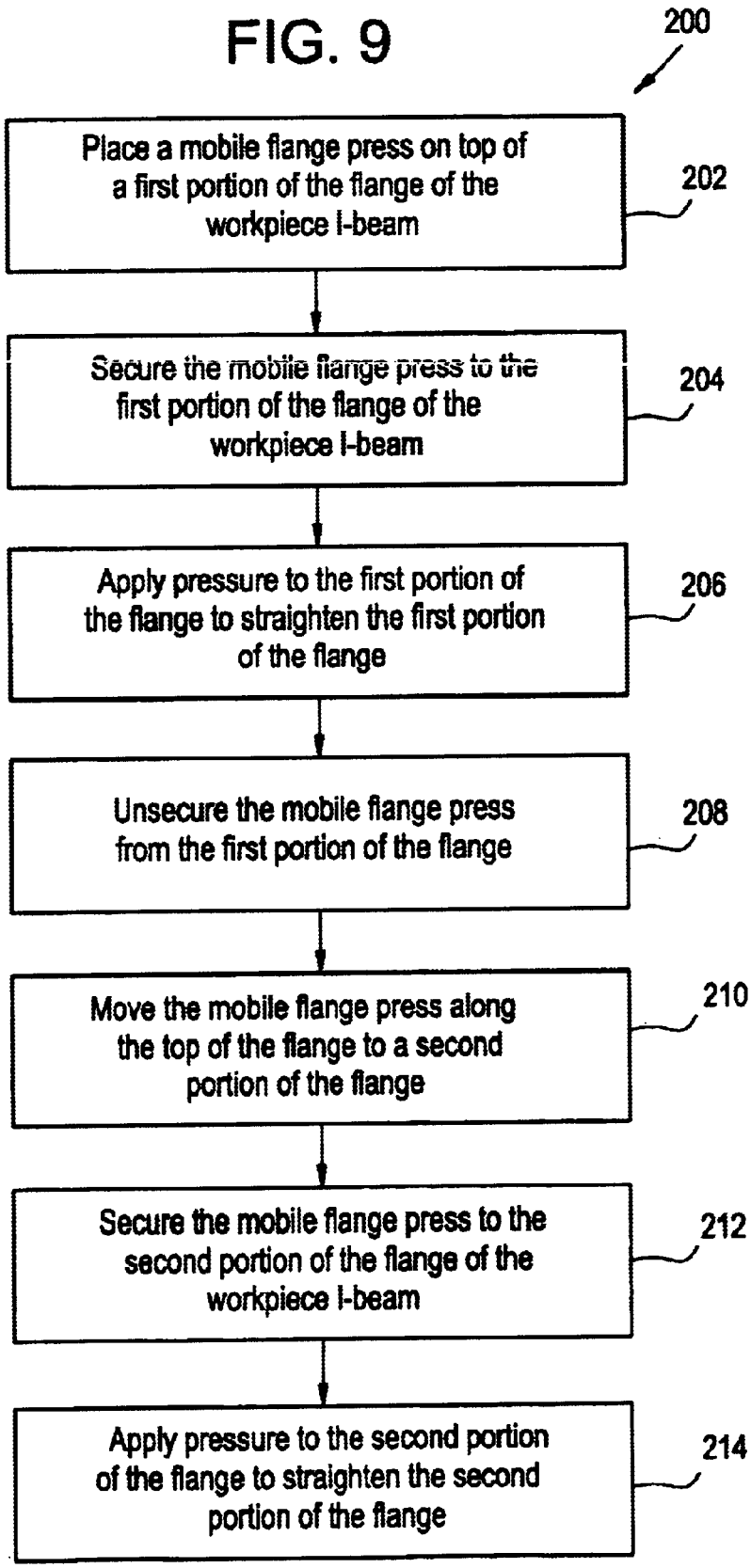
FIG. 9 shows a schematic flow diagram of a method of straightening flanges of a workpiece I-beam in accordance with one embodiment of the present invention.

It should be evident from the discussion above, another aspect of the present invention is in providing an improved method of straightening flanges of a workpiece I-beam. FIG. 9 shows a schematic flow diagram 200 of a method of straightening flanges of a workpiece I-beam in accordance with one embodiment of the present invention. It should be noted that the schematic flow diagram 200 is merely one example of a method in accordance with the present invention, and in this regard, various minor steps such as operation of the monitoring mechanism described above has been omitted.

As can be seen in FIG. 9, the present embodiment of the method includes step 202 in which a mobile flange press is placed on top of a first portion of the flange of the workpiece I-beam. In step 204, the mobile flange press is secured to the first portion of the flange of the workpiece I-beam and pressure is applied to the first portion of the flange in step 206 to straighten the first portion of the flange. Then, the mobile flange press is unsecured from the first portion of the flange in step 208 and moved along the top of the flange to a second portion of the flange in step 210. In step 212, the mobile flange press is secured to the second portion of the flange of the workpiece I-beam, and pressure is applied to the second portion of the flange to straighten the second portion of the flange in step 214. Of course, the above steps may be repeated along the length of the workpiece I-beam to straighten the entire length of the workpiece I-beam. In addition, it should be evident that the above described method in accordance with the present invention may be executed using the mobile flange press in accordance with the present invention discussed above, details of which is shown in the various figures.

Furthermore, it should also be noted that additional steps may be provided in practicing the method of the present invention described above. For instance, before step 202, the operator may determine the correction distance cd shown in FIG. 3, for example, at 5 feet intervals along the workpiece I-beam and mark the flange of the workpiece I-beam accordingly. The operator then may determine if there is an average correction distance $Cd_{ave}$ which he could set the mobile flange press at that would allow straightening of all, or significant portion, of the workpiece I-beam to be within allowable tolerances in a continuous manner without readjusting the monitoring mechanism described above, if provided. In addition, steps including the above described steps for setting the monitoring mechanism, for instance, to an average correction distance $Cd_{ave}$, and additional checking steps may also be provided in other embodiments of the method in accordance with the present invention.

Figure 10:
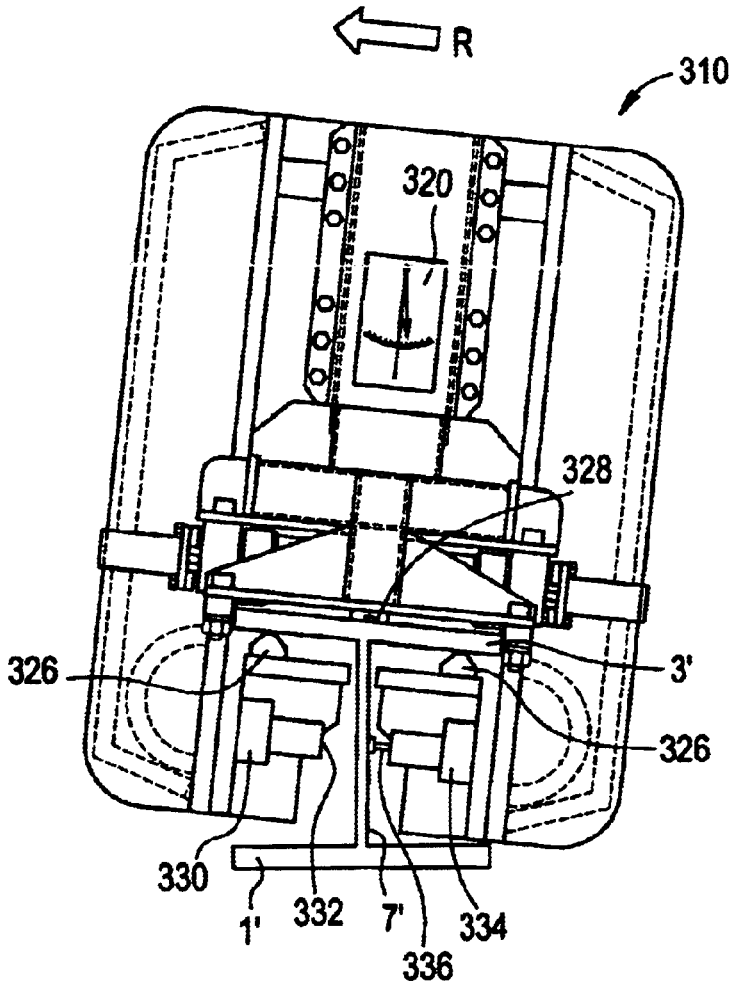
FIG. 10 is a frontal view of the mobile flange press in accordance with another embodiment of the present invention.

FIG. 10 illustrates a mobile flange press 310 in accordance with yet another embodiment of the present invention. The features and components that are common with the other embodiments discussed in detail above are not enumerated to enhance clarity. As will be explained below, this embodiment of the mobile flange press provides the ability to correct distortion of workpiece I-beams that are caused by improper fitting of the flange or when different amount of heat is applied to the flange from each side of the web welds. In particular, in such situations, the distortion shown in FIG. 11 results in which the flange 3' of the workpiece I-beam 1' is not perpendicular to the web 7'.

Figure 11:
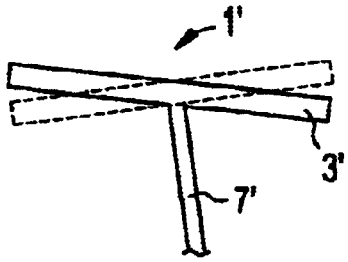
FIG. 11 is an end view of a workpiece I-beam, having distortion of the flange due to improper mounting of the flange onto the web, the distortion being shown exaggerated.

In this regard, the mobile flange press 310 shown in FIG. 10 has been mounted to a workpiece I-beam 1' having such a distortion of FIG. 11. Before any bowing of the flange 3' such as that shown in FIG. 3 is repaired by the mobile flange press 310 in the manner described in detail above, the position of the flange 3' should be first corrected so that the flange 3' is perpendicular to the web 7'. The problem with correcting the position of the flange 3' by bending the flange 3' is that the weld that secures the flange 3' to the web 7' is actually stronger than the web 7' itself. Thus, when attempts are made to straighten the flange 3', the web 7' itself bends causing a curve to be formed thereon which is undesirable. This problem may be addressed by applying heat to the weld to lower the strength of the weld to less than the strength of the web 7'. However, such application of heat makes straightening of the workpiece I-beam 1' more complicated and cumbersome and can also weaken the weld itself. As discussed below, the illustrated mobile flange press 310 of FIG. 10 may be used to correct the position of the flange 3' without applying heat.

In the above regard, the mobile flange press 310 is provided with a plumb indicator 320 that provides the operator of the mobile flange press 310 with information regarding the degree of the distortion, i.e. the inclination or tilt of the flange 3'. As can be seen in FIG. 10, in this embodiment, the plumb indicator includes a pointer and a scale that together indicates the amount of inclination or tilting of the mobile flange press 310. Of course, in other embodiments, the plumb indicator may include electronic displays such as LCD screens or the like that provide a numerical reading of the amount of inclination/tilting of the mobile flange press 310. In addition, the mobile flange press 310 further includes a first and second lateral presses 330 and 334, respectively. The first and second lateral presses 330 and 334 include extensible plungers 332 and 336, respectively, which are adapted to extend and retract to contact the web 7' of the workpiece I-beam 1'. The first and second lateral presses 330 and 334 are used in the manner described below to straighten the flange 3' so that it is perpendicular to the web 7', this being attained by actuating the appropriate lateral press to cause the mobile flange press 310 to tilt in the opposing direction.

In particular, the hydraulic cylinder (not shown) of the mobile flange press 310 is actuated so that the flange 3' is engaged between the contact bits 326 and the punch 328. Sufficient force is then exerted by the hydraulic cylinder to slightly bend the flange 3' in the manner described in the previous embodiments so that the flange 3' is stressed sufficiently to reach the yield point of the flange 3'. It should be noted that the amount of bending is preferably very slight, just enough to approximately reach the yield point of the flange 3', and is not bent to the extent of the correction distance cd depicted in FIG. 3. In this regard, if a monitoring mechanism described in the previous embodiment of FIGS. 8A and 8B is provided, it may be set to only slightly bend the flange 3'.

Then, upon reaching the approximate yield point of the flange 3' using the hydraulic cylinder, the plunger of the appropriate lateral press is extended to exert force on the web 7'. This extension of the plunger causes the mobile flange press 310 to rotate about its weld with the web 7' thereby rotating the flange 3' to which the mobile flange press 310 is mounted to. Thus, in the illustration of FIG. 10, the plunger 336 of the second lateral press 334 is extended so that the plunger 336 abuts against the web 7' and exerts a force thereon. This causes the mobile flange press 310 to rotate in the direction of arrow R. Because the flange 3' is secured between the contact bits 326 and the punch 328, and because the flange 3' is at its substantial yield point, the rotation of the mobile flange press 310 causes the flange 3' to be straightened relative to the web 7'. The plunger 336 of the second lateral press 334 is extended sufficiently so that the flange 3' is bent to be perpendicular to the web 7'. The amount of bending, and correspondingly, the perpendicularity between the flange 3' and the web 7' may be monitored using the plumb indicator 320.

The additional force generated by the second lateral press 334 is preferably sufficient to cause the rotation of the mobile flange press 310 and the flange 3' about the weld between the flange 3' and the web 7'. Preferably, because the hydraulic cylinder (not shown) of the mobile flange press 310 is actuated to slightly bend the flange 3', thus, bringing the flange 3' to yield stress levels, the first and second lateral presses 330 and 334 need not be very large or have high force capacity. In this regard, the first and second lateral presses 330 and 334 may be significantly smaller than the hydraulic cylinder and may be hydraulically actuated or actuated in some other appropriate manner. In the above described manner, the flange 3' of the workpiece I-beam 1' may be bent to be perpendicular to the web 7' without requiring application of heat to the welds.

Then, once the flange 3' is bent to be perpendicular to the web 7', any other distortions on the flange 3' such as that described above relative to FIG. 3, may be straightened using the mobile flange press 310 in the manner previously described relative to FIGS. 1 to 8B. Of course, the illustrated rotation of the mobile flange press 310 is provided as an example only and may be rotated using the first and second lateral presses 330 and 334, respectively, in any direction appropriate to bend the flange 3' so that it is perpendicular to the web 7'.

Thus, it should now be apparent that a mobile flange press and a method for straightening a flange of a workpiece I-beam are provided by the present invention in which the mobile flange press is moved along the flange of the stationary workpiece I-beam. As can be appreciated from the discussion above, the mobile flange press and method in accordance with the present invention allows straightening and/or removal of the previously described distortions in the flange of a workpiece I-beam at various worksite locations where the workpiece I-beams are located thereby allowing economic straightening of flanges.

While various embodiments in accordance with the present invention have been shown and described, it is understood that the invention is not limited thereto. The present invention may be changed, modified and further applied by those skilled in the art. For instance, various embodiments of the present invention may be provided in which the mobile flange press is provided with only selected number of features. Of course in other embodiments, the mobile flange press may be provided with all of the above described features. In addition, different number of components such as the hydraulic cylinders may be provided. Therefore, this invention is not limited to the detail shown and described previously, but also includes all such changes and modifications.

We claim:

1. A mobile flange press adapted to be mounted on a flange of a workpiece I-beam and moved thereon, the mobile flange press comprising:

at least one clamp that contacts an underside of the flange of the workpiece I-beam;

at least one hydraulic cylinder adapted to apply vertical downward pressure on the flange to straighten said flange; and a drive mechanism for moving said mobile flange press along the flange of the workpiece I-beam to another portion of the flange.

2. The mobile flange press of claim 1, wherein said drive mechanism includes a drive motor and rollers adapted to roll said mobile flange press along the flange of the workpiece I-beam.

3. The mobile flange press of claim 2, wherein said drive mechanism includes a lift mechanism for lifting and lowering said mobile flange press relative to the flange of the workpiece I-beam.

4. The mobile flange press of claim 2, wherein the roller is elongated in shape.

5. The mobile flange press of claim 1, wherein said at least one hydraulic cylinder is a plurality of hydraulic cylinders aligned in-line along length of said mobile flange press.

6. The mobile flange press of claim 1, further including a monitoring mechanism adapted to monitor amount of straightening to the flange of the workpiece I-beam.

7. The mobile flange press of claim 6, wherein said monitoring mechanism includes a limit switch for indicating when the flange of the workpiece I-beam has been straightened a predetermined amount.

8. The mobile flange press of claim 1, further including a controller for controlling operation of said mobile flange press.

9. The mobile flange press of claim 8, wherein said controller controls movement of said mobile flange along the flange of the workpiece I-beam.

10. The mobile flange press of claim 1, further including an adjustment mechanism for allowing dimensional adjustment of said mobile flange press to accommodate workpiece I-beams of varying dimensions.

11. The mobile flange press of claim 1, further including guides for limiting lateral movement of the mobile flange press relative to the workpiece I-beam.

12. The mobile flange press of claim 1, further including a cylinder stop assembly to prevent full extension of said at least one hydraulic cylinder.

13. The mobile flange press of claim 1, further including at least one lateral press adapted to exert a lateral force on a web of the workpiece I-beam.

14. The mobile flange press of claim 13, wherein said at least one lateral press is at least two lateral presses adapted to exert a lateral force on both sides of the web of the workpiece I-beam.

15. The mobile flange press of claim 13, further including a plum indicator for indicating inclination of the mobile flange press.

16. The mobile flange press of claim 2, wherein said at least one hydraulic cylinder is a plurality of hydraulic cylinders aligned in-line along length of said mobile flange press.

17. The mobile flange press of claim 16, further including a controller for controlling operation of said mobile flange press, said controller controlling movement of said mobile flange along the flange of the workpiece I-beam.

18. The mobile flange press of claim 17, wherein said drive mechanism includes a lift mechanism for lifting and lowering said mobile flange press relative to the flange of the workpiece I-beam.

19. The mobile flange press of claim 17, further including adjustment mechanism for allowing dimensional adjustment of said mobile flange press to accommodate workpiece I-beams of varying dimensions.

20. The mobile flange press of claim 17, further including a monitoring mechanism adapted to monitor amount of straightening to the flange of the workpiece I-beam, said monitoring mechanism including a limit switch for indicating when the flange of the workpiece I-beam has been straightened a predetermined amount.

21. The mobile flange press of claim 17, further including guides for limiting lateral movement of the mobile flange press relative to the workpiece I-beam.

22. The mobile flange press of claim 17, further including a cylinder stop assembly to prevent full extension of said plurality of hydraulic cylinders.

23. The mobile flange press of claim 17, further including at least two lateral presses adapted to exert a lateral force on both sides of the web of the workpiece I-beam.

24. The mobile flange press of claim 17, further including a plum indicator for indicating inclination of the mobile flange press.

25. A method of straightening flanges of a workpiece I-beam comprising the steps of:

placing a mobile flange press on top of a first portion of the flange of the workpiece I-beam;

securing said mobile flange press to the first portion of the flange of the workpiece I-beam;

applying pressure to the first portion of the flange to straighten the first portion of the flange;

unsecuring said mobile flange press from the first portion of the flange; and moving said mobile flange press along the top of the flange;

wherein said step of moving said mobile flange press along the top of the flange is attained by a drive mechanism secured to said mobile flange press.

26. The method of claim 25, wherein said mobile flange press is moved along the top of the flange to a second portion of the flange, and further including the step of securing said mobile flange press to the second portion of the flange of the workpiece I-beam.

27. The method of claim 26, further including the step of applying at least pressure to the second portion of the flange to straighten the second portion of the flange.

28. The method of claim 25, wherein said step of applying pressure is attained by at least one hydraulic cylinder that applies vertical downward pressure on the flange.

29. The method of claim 25, wherein said step of securing said mobile flange press is attained by at least one clamp that contacts an underside of the flange.

30. The method of claim 25, further including the step of monitoring amount of straightening to the flange.

31. A method of straightening flanges of a workpiece I-beam comprising the steps of:

placing a mobile flange press on top of a first portion of the flange of the workpiece I-beam;

securing said mobile flange press to the first portion of the flange of the workpiece I-beam;

applying pressure to the first portion of the flange to straighten the first portion of the flange;

unsecuring said mobile flange press from the first portion of the flange;

moving said mobile flange press along the top of the flange; and rotating the mobile flange press by exerting a lateral force on a web of the workpiece I-beam.

32. The method of claim 25, further including the step of monitoring inclination of the mobile flange press.

33. The method of claim 28, wherein said step of securing said mobile flange press is attained by at least a clamp that contacts an underside of the flange.

34. The method of claim 33, further including the step of monitoring amount of straightening to the flange.

35. The method of claim 33, further including the step of monitoring inclination of the mobile flange press.

36. The method of claim 33, further including the step of rotating the mobile flange press based on inclination of the flange press.

37. The method of claim 33, wherein said mobile flange press is moved along the top of the flange to a second portion of the flange, and further including the step of securing said mobile flange press to the second portion of the flange of the workpiece I-beam.

38. The method of claim 37, further including the step of applying at least pressure to the second portion of the flange to straighten the second portion of the flange.

* * * * *